US006129018A

United States Patent [19]

Koppelkamm

[11] Patent Number: 6,129,018

[45] Date of Patent: Oct. 10, 2000

[54] IMPRESSION CYLINDER WITH A SLOT FOR RECEIVING ELASTIC MOLDED ENDS OF FLEXIBLE PLATE

[75] Inventor: Günter Koppelkamm, Neuensalz, Germany

[73] Assignee: MAN Roland Druckmaschinen AG, Offenbach am Main, Germany

[21] Appl. No.: 09/286,945

[22] Filed: Apr. 8, 1999

[30] Foreign Application Priority Data

Apr. 9, 1998 [DE] Germany ..... 198 15 935

[51] Int. Cl.[7] ..... B41F 27/12

[52] U.S. Cl. ..... 101/415.1; 101/389.1

[58] Field of Search ..... 101/415.1, 389.1

[56] References Cited

U.S. PATENT DOCUMENTS 4,304,182 12/1981 Etchell et al. ..... 101/415.1
5,375,520 12/1994 Köbler et al. ..... 101/415.1

FOREIGN PATENT DOCUMENTS 0 827 830 3/1998 European Pat. Off. .
43 03 381 12/1994 Germany .
296 000 845 4/1996 Germany .
196 36 412 1/1998 Germany .

*Primary Examiner*—John S. Hilten
*Assistant Examiner*—Daniel J. Colilla
*Attorney, Agent, or Firm*—Cohen, Pontani, Lieberman & Pavane

[57] ABSTRACT

An impression cylinder for a rotary printing machine is equipped with outlet orifices for feeding a pressure medium into a slot for the purpose of lifting off a flexible plate from the outer surface of the impression cylinder. The orifice on the circumference of the impression cylinder is inclined in the direction of rotation of the cylinder. The ends of the plate are insertable into the slot and are secured therein against slipping out. The impression cylinder includes a cavity which runs in the longitudinal direction separately from the slot and is capable of being subjected to the pressure medium. The cavity includes at least one duct which is connected to the outlet orifice arranged in a side face of the slot. The side face is adjacent to the trailing end of the plate in the region of the slot orifice on the circumference of the impression cylinder.

11 Claims, 3 Drawing Sheets

IMPRESSION CYLINDER WITH A SLOT FOR RECEIVING ELASTIC MOLDED ENDS OF FLEXIBLE PLATE

BACKGROUND OF THE INVENTION

1. Field of the Invention

The present invention relates to rotary printing machines, and more particularly, to an impression cylinder for a rotary printing machine.

2. Description of the Related Art

DE 196 36 412 C1 discloses a cylinder which is equipped with outlet orifices for feeding a pressure medium into a slot for the purpose of lifting off a flexible plate from the outer surface of the impression cylinder. The orifice on the circumference of the impression cylinder is inclined in the direction of rotation of the latter. The ends of the plate are insertable into the slot. In order to prevent the ends from slipping out of the slot, they are clamped against the slot side face adjacent to the end which is the leading end in the direction of rotation by means of a shaft fitted with a pressure cam. The slot is provided at its inner end with a pressure-medium feed in the form of a bore or of a tube arranged in a widening of the slot and having outlet orifices.

The pressure medium introduced into the slot can spread out, unimpeded, in the latter and escape at all the outwardly open points of the slot, thus impairing its effectiveness in assisting in the lifting-off of the trailing end of the plate from the cylinder. Moreover, the clamping of the ends in the slot necessitates a relatively high technical outlay.

Another solution is already known from DE 296 000 845 U1, in which blowing air assists in the removal of a plate from the impression cylinder. Air is blown out of a spindle, which causes the ends of the plate to be clamped in a cylinder gap, under the trailing end of the plate in the direction of the region of the entrance to the cylinder gap. The spindle possesses blowing bores which are connected to a feed duct extending as far as one end face of the spindle at the center of the latter.

SUMMARY OF THE INVENTION

It is therefore an object of the invention to provide an impression cylinder which secures the ends of the plate in the slot in a simple way, so as to prevent them from unintentionally slipping out. It is another object of the invention to make it possible, when changing the plate, to draw the trailing end out of the slot by simple technical means and using a small amount of pressure medium with as little effort as possible.

These and other objects are achieved by providing an impression cylinder which allows an effective feed of the pressure medium directly at the required point. The closed impression-cylinder cavity, which is connected to the slot solely via the ducts and which is simple to produce, largely prevents the pressure medium from escaping via the slot so as to be ineffective for the lifting-off operation. In addition to the optimum placement of the ducts for feeding the pressure medium in the region of the orifice of the slot, they can also be produced with little outlay through the orifice. The ends of the plate are sufficiently secured against unintentional slipping out of the slot by means of the elastic molded elements. The molded elements also make it possible to draw out the ends of the plate with the assistance of the pressure medium when a plate is changed.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is explained in more detail below with reference to an exemplary embodiment. In the accompanying drawings.

DETAILED DESCRIPTION OF THE PRESENTLY PREFERRED EMBODIMENTS

Figure 1:
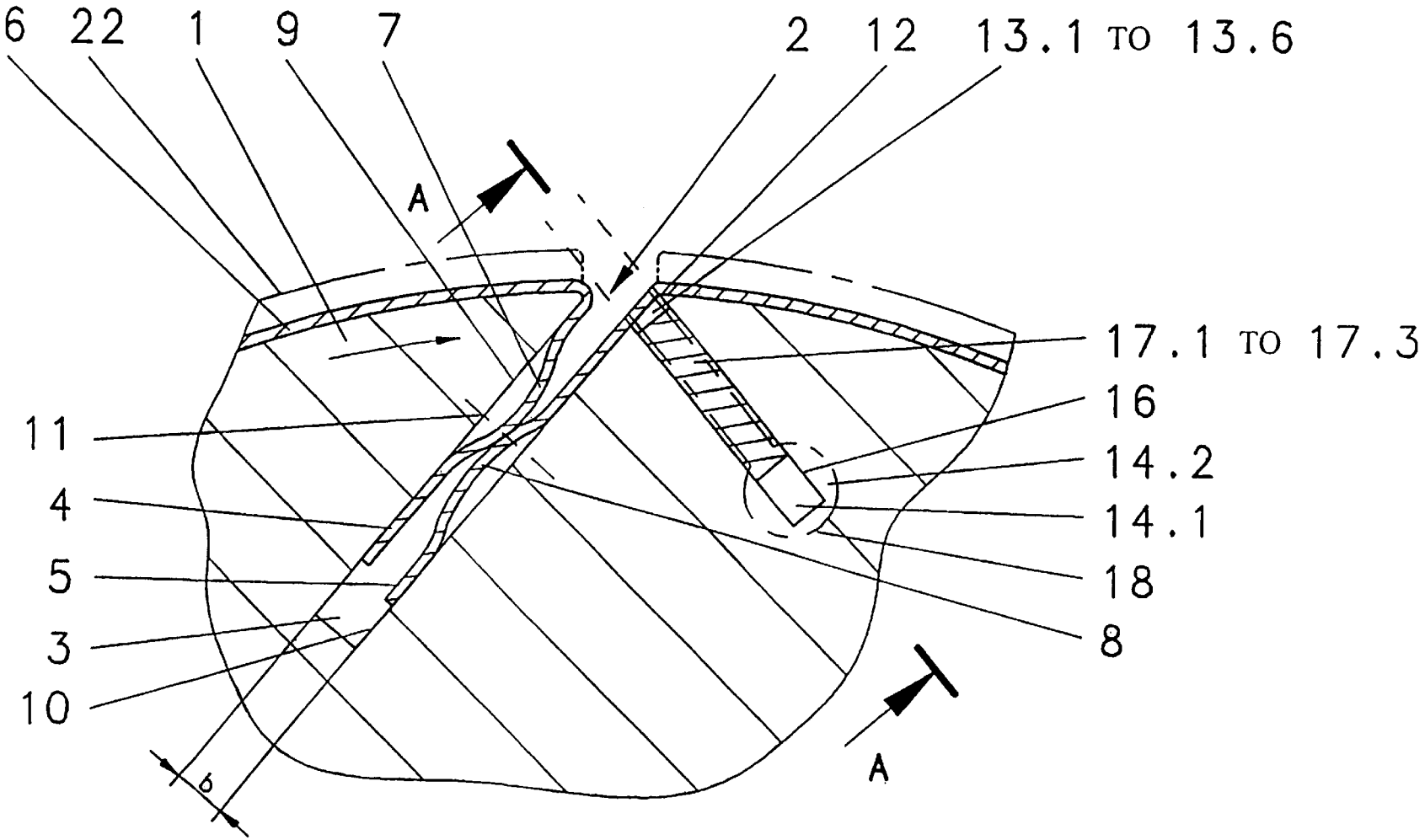
FIG. 1 is a cross-sectional view of the impression cylinder having a device for fastening the ends of a plate in accordance with an embodiment of the invention.

FIG. 1 shows a detail of an impression cylinder 1 having a slot 3 which runs in the longitudinal direction and of which the orifice 2 on the circumference of the impression cylinder 1 is inclined in the direction of rotation of the cylinder 1, and into which bent ends 4 and 5 of a plate 6 drawn on the circumference of the impression cylinder are inserted. The ends possess elastic press mouldings in the form of boss-like convexities 7 and 8, as illustrated, or of longitudinally running beads, not illustrated, which, within the slot 3, cause the ends 4 and 5 of the plate 6 to be respectively clamped against side faces 9 and 10 of the slot 3.

Figure 2:
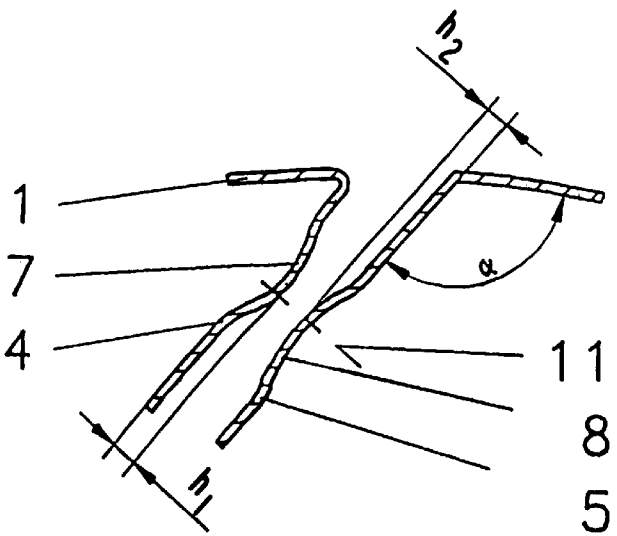
FIG. 2 is a detailed view of the non-clamped ends of the plate outside the slot of the device of FIG. 1.

When the plate 6 is being laid in place, first the end 4 (i.e., the leading end in the direction of rotation of the impression cylinder 1) is bent at an acute angle and introduced into the slot 3 and positively held there, via its bent portions, during the subsequent drawing of the plate 6 on the circumference of the impression cylinder 1. Finally, the trailing end 5 (bent only at an obtuse angle), is inserted. In order to secure the trailing end 5 in the slot 3, during operation, its convexity 8 is radially offset into the interior of the slot 3 in relation to the convexity 7 of the leading end. With respect to the position of mutual contact 11 between the convexities 7 and 8 in the clamping position in the slot 3, the sum of the heights $h_1$, and $h_2$ of the respective stress-relieved convexities 7 and 8 outside the slot (FIG. 2) corresponds at least to the width b of the slot 3 ($h_1+h_2 \geqq b$). By contrast, if the trailing end 5 of the plate 6 is bent at a larger obtuse angle $\alpha$ as compared with the oblique position of slot 3, and is consequently resiliently pushed into the slot 3, under prestress, the ends 4 and 5 catch in the slot 3 even when the sum of the respective heights $h_1$ and $h_2$ is smaller than the width b of the slot ($h_1+h_2 < b$).

The invention is not limited by the embodiments described above which are presented as examples only but can be modified in various ways within the scope of protection defined by the appended patent claims.

On the one hand, even at a high rate of revolutions of the impression cylinder, the ends 4 and 5 of the plate are sufficiently secured in the slot 3 as a result of the clamping described. On the other hand, when the plate 6 is being removed, drawing out the trailing end 5 requires an effort which corresponds to the clamping in the slot. Through the introduction of a pressure medium, such as compressed air, on that side face 10 of the slot 3 which is adjacent to the trailing end 5, in the region of the slot orifice 2, the required effort can be reduced considerably and still cause the plate 6 to be lifted off from the outer surface of the impression cylinder 1. For this purpose, in each case, an outlet orifice 12 for the compressed air is connected to and aligned with the orifice 2 of the slot 3 by means of a duct 13.1 to 13.6. This enables the production of compressed air through the orifice 2, to a cavity 14.1, 14.2 which runs in the impression cylinder 1 and in the longitudinal direction of the latter and which includes an orifice laterally disposed on the impression cylinder 1, for feeding the compressed air for the purpose of changing the plate 6.

Figure 4:
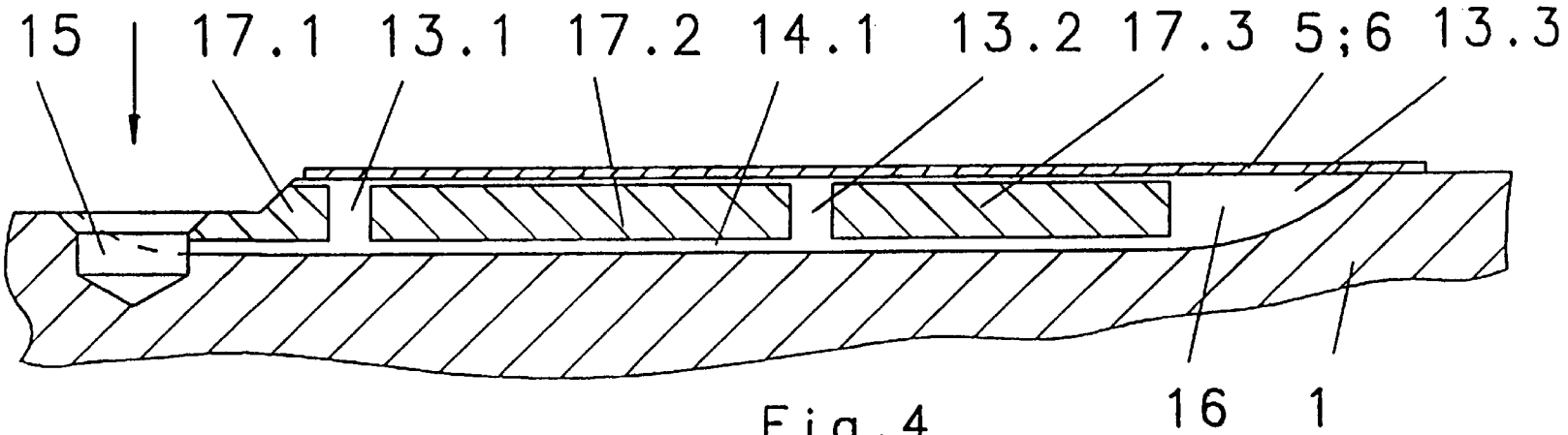
FIG. 4 is a cross-sectional view of the embodiment of FIG. 1, taken along line A—A.
Figure 5:
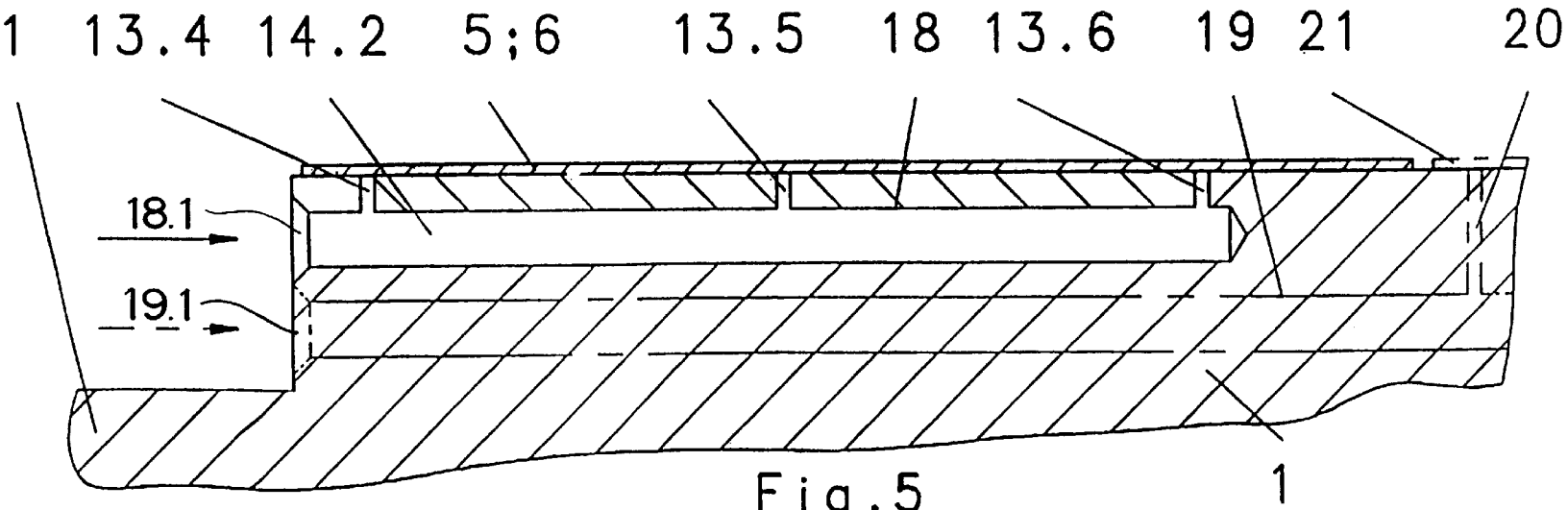
FIG. 5 is another cross sectional view taken along line A—A of FIG. 1.

FIGS. 4 and 5 show, as the section A—A of FIG. 1, two variations of the embodiment of the ducts 13.1 to 13.3 or 13.4 to 13.6 and the cavity 14.1 or 14.2.

According to the first embodiment shown in FIG. 1 a slot 16 is in alignment with the orifice 2 of the slot 3, and extends over the width of the plate 6 and terminates laterally on the impression cylinder 1 in a bore 15 for feeding the pressure medium. Plastic or metal filling pieces 17.1 to 17.3, are disposed and glued in the slot 16 and form the ducts 13.1, 13.2, 13.3 and the cavity 14.1 (FIG. 4). By contrast, in the modified embodiment illustrated by broken lines in FIG. 1, the cavity 14.2 in the impression cylinder 1 is designed as a bore 18 which extends in the longitudinal direction of the cylinder and is open on the side of the said cylinder for the compressed-air feed and in which bore-like ducts 13.4, 13.5, 13.6 terminate (FIG. 5).

Figure 3:
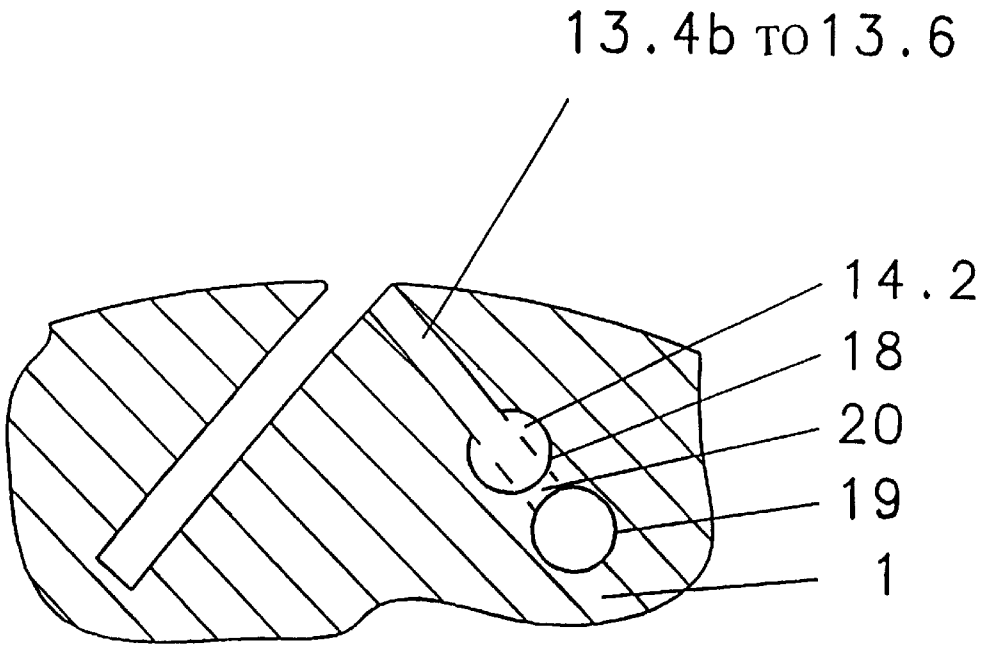
FIG. 3 is a variation the embodiment of FIG. 1 showing the pressure-medium feed for two plates being arranged next to one another on the impression cylinder.

In FIG. 3, for the purpose of arranging a plurality of plates next to one another, the impression cylinder 1 is equipped, on its circumference, with devices separate from the plate, for feeding the pressure medium. In this case, according to the illustration shown in broken lines in FIG. 5, a second bore 19, in which bore-like ducts 20 for a second plate 21 terminate, runs in the impression cylinder 1 so as to be axially offset parallel to the bore 18.

If, for example, four plates are arranged next to one another on the impression cylinder 1, the bores 18 and 19 in each case run in that half of the impression cylinder which is fitted with two plates and each possess an orifice 18.1, 19.1 for feeding the pressure medium (FIG. 5) on the associated side of the said impression cylinder.

The plate 6 may be designed both as a printing plate for a form cylinder and as a carrier plate of a rubber blanket 22 (illustrated by broken lines in FIG. 1) for a transfer cylinder. The rubber blanket being fixedly connected to the said carrier plate.

While there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. An impression cylinder of a rotary printing machine comprising:

a flexible plate having ends for releasably securing said plate to an outer surface of the impression cylinder;

a first slot for receiving said ends of said plate, said ends being secured in said first slot, said first slot having a slot orifice on a circumference of the impression cylinder, opposing side faces and a width;

at least one outlet orifice disposed in one of said side faces of said slot for feeding a pressure medium into said first slot, said one of said side faces being adjacent to one of said ends of said plate that is a trailing end in a direction of rotation of the impression cylinder in a region of said slot orifice and which is aligned with said slot orifice;

a cavity disposed in the impression cylinder and running in a longitudinal direction parallel to a longitudinal axis of the cylinder separate from said first slot, said cavity having at least one duct connected to said at least one outlet orifice; and a plurality of flexible plates arranged next to one another in an axial direction on the circumference of the impression cylinder, said impression cylinder further comprising a separate cavity and associated ducts for each of said plurality of plates, said plurality of plates comprising four plates arranged next to one another on the circumference of the impression cylinder, the cavities of two plates on one-half of the impression cylinder running offset and parallel to one another and laterally terminating in a respective half in an orifice for connection of the pressure medium.

2. The impression cylinder in accordance with claim 1, wherein said ends of said plate comprise elastic press moldings which cooperate in said first slot to clamp said ends against said side faces of said first slot, wherein in operation the press molding of the trailing end is arranged within the first slot inwardly and radially behind the press molding of a leading end.

3. An impression cylinder of a rotary printing machine comprising:

a flexible plate having ends for releasably securing said plate to an outer surface of the impression cylinder;

a first slot for receiving said ends of said plate, said ends being secured in said first slot, said first slot having a slot orifice on a circumference of the impression cylinder, opposing side faces and a width;

at least one outlet orifice disposed in one of said side faces of said slot for feeding a pressure medium into said first slot, said one of said side faces being adjacent to one of said ends of said plate that is a trailing end in a direction of rotation of the impression cylinder in a region of said slot orifice and which is aligned with said slot orifice; and a cavity disposed in the impression cylinder and running in a longitudinal direction parallel to a longitudinal axis of the cylinder separate from said first slot, said cavity having at least one duct connected to said at least one outlet orifice, said ends of said plate comprising elastic press moldings which cooperate in said first slot that clamps the ends against said side faces of said first slot, wherein in operation the press molding of the trailing end is arranged within the first slot inwardly and radially behind the press molding of a leading end, said trailing end being bent at an angle larger than an oblique position of said first slot, said trailing end being resiliently pushed into said first slot under pre-stress such that the sum of the respective heights of non-loaded press moldings outside said slot with respect to a position of mutual contact within said first slot is smaller than the width of said first slot.

4. The impression cylinder in accordance with claim 3, wherein said plate comprises a printing plate.

5. The impression cylinder in accordance with claim 3, wherein said plate comprises a carrier plate for a rubber blanket fixedly connected to the carrier plate, wherein said ends are introduced into slot free of said rubber blanket.

6. An impression cylinder of a rotary printing machine comprising:

a flexible plate having ends for releasably securing said plate to an outer surface of the impression cylinder;

a first slot for receiving said ends of said plate, said ends being secured in said first slot, said first slot having a slot orifice on a circumference of the impression cylinder, opposing side faces and a width;

at least one outlet orifice disposed in one of said side faces of said slot for feeding a pressure medium into said first slot, said one of said side faces being adjacent to one of said ends of said plate that is a trailing end in a direction of rotation of the impression cylinder in a region of said slot orifice and which is aligned with said slot orifice; and a cavity disposed in the impression cylinder and running in a longitudinal direction parallel to a longitudinal axis of the cylinder separate from said first slot, said cavity having at least one duct connected to said at least one outlet orifice, said ends of said plate comprising elastic press moldings which cooperate in said first slot to clamp said ends against said side faces of said first slot, wherein in operation the press molding of the trailing end is arranged within the first slot inwardly and radially behind the press molding of a leading end, said press moldings comprising boss-like convexities.

7. The impression cylinder in accordance with claim 6, wherein said press moldings each comprise a height outside of said first slot with respect to a position of mutual contact within said first slot such that a sum of said heights is at least equal to said width of said first slot.

8. The impression cylinder in accordance with claim 6, wherein said cavity comprises a bore having a lateral orifice on an end side of the impression cylinder for feeding the pressure medium.

9. The impression cylinder in accordance with claim 6, wherein said cavity comprises:

a second slot having an opening on one of said side faces of said first slot and being aligned with said slot orifice; and at least one filling piece disposed within said second slot for forming said at least one duct.

10. The impression cylinder in accordance with claim 9, wherein said at least one filling piece is fixed into said second slot.

11. The impression cylinder in accordance with claim 9, further comprising a bore for feeding the pressure medium, said second slot laterally terminating on the impression cylinder in said bore.

* * * * *